US008636946B1

(12) United States Patent
Olver

(10) Patent No.: US 8,636,946 B1
(45) Date of Patent: Jan. 28, 2014

(54) BELL ANNEALING FURNACE

(75) Inventor: John W. Olver, Blacksburg, VA (US)

(73) Assignee: Emisshield, Inc., Blacksburg, VA (US)

( * ) Notice: Subject to any disclaimer, the term of this patent is extended or adjusted under 35 U.S.C. 154(b) by 387 days.

(21) Appl. No.: 12/422,858

(22) Filed: Apr. 13, 2009

(51) Int. Cl.
*C21D 1/00* (2006.01)

(52) U.S. Cl.
USPC ..... 266/256; 266/249

(58) Field of Classification Search
USPC ..... 266/249, 256
See application file for complete search history.

(56) References Cited

U.S. PATENT DOCUMENTS 2,283,982 A 5/1942 Germany
2,485,061 A * 10/1949 Nebe ..... 148/276
4,074,010 A * 2/1978 Knight ..... 428/422
4,502,671 A 3/1985 Omura
4,504,957 A 3/1985 McClelland et al.
5,296,288 A 3/1994 Kourtides et al.
6,063,331 A 5/2000 Iszczukiewicz
6,921,431 B2 7/2005 Evans et al.
7,105,047 B2 9/2006 Simmons et al.
2009/0252660 A1* 10/2009 Olver et al. ..... 422/197
2009/0293786 A1* 12/2009 Olver ..... 110/336
2010/0038061 A1* 2/2010 Olver et al. ..... 165/134.1

* cited by examiner

*Primary Examiner* — Scott Kastler
(74) *Attorney, Agent, or Firm* — Mary-Jacq Holroyd; Johnston Holroyd

(57) ABSTRACT

Thermal protective layer on metallic and/or ceramic substrate surfaces within/on an outer cover, an inner cover, a base/door, and/or a support member within a bell annealing furnace has from about 5% to about 30% of an inorganic adhesive, from about 45% to about 92% of a filler and from about 1% to about 20% of one or more emissivity agents, or from about 5% to about 35% of colloidal silica, colloidal alumina, or combinations thereof, from about 23% to about 79% of a filler, and from about 1% to about 20% of one or more emissivity agents.

14 Claims, 3 Drawing Sheets

BELL ANNEALING FURNACE

BACKGROUND OF THE INVENTION

The present invention relates to batch annealing apparatuses, and in particular to bell annealing apparatuses and processes in which annealable materials are annealed in a controlled atmosphere.

The annealing process subjects an alloy, metal, glass, special polymer, or the like to a process of heating and cooling to make it tougher, less brittle, more resistant to fracture, and the like, and/or to depart some special characteristic(s) thereto. Annealing minimizes internal defects in the atomic structure of the material and leaves it free from internal stresses that might otherwise be present because of prior processing steps. Annealing can be used to restore the ductility of work hardened metals and alloys, and to depart particular electrical characteristics on circuit components. Numerous types of annealing materials are known in the art.

Ferrous and nonferrous metals, including carbon/stainless steel and exotic alloys, and glass are annealed by heating them to high temperatures and cooling them slowly; copper and silver, however, are best annealed by heating and cooling quickly, then immersing in water. Batch annealing apparatuses and processes have been used for many years to anneal coils of materials such as coils of steel strip, wire, or rod, and to anneal panels, discrete objects, such as microchips (or processors), glass, and the like. Metallic coil annealing practices, for example, are used in the manufacture of punching quality oriented silicon steel, regular grain oriented silicon steel, high permeability oriented silicon steel, and all types/alloys of stainless steel.

The external dimensions of bell annealing furnaces vary greatly. Bell annealing furnaces, which are also known as box annealing furnaces, are used in industrial batch annealing processes, in both small and large scale applications. Large masses of metal or glass are cooled within industrial sized annealing furnaces in which cranes, or the like, are used to lift the furnace off of a base which holds the annealable materials thereon. Table top annealing furnaces may be used in academic settings and for small scale manufacturing purposes, and may have doors in the side which enclosed an opening within the furnace that holds the annealable materials therein. Some large scale annealing furnaces may also have a door in the side which enclosed an opening within the furnace that holds the annealable materials therein.

Annealing time, especially of glass, varies widely according to the thickness of the individual piece. Window glass, for example, requires several hours; plate glass, several days; and glass mirrors for reflecting telescopes, several months. Annealing is required as an intermediate step in metal-forming processes such as wire drawing or brass stamping in order to restore the ductility of the metal lost because of work hardening during the forming operation. Other applications are also well known in the art.

At minimum, a bell annealing furnace includes an outer furnace structure or cover, and an inner cover structure disposed within the outer furnace structure. A heating means is disposed within the furnace to heat the space between inner and outer structures, or more specifically, to heat the external surface of the inner cover structure. Bell type annealing furnaces may be direct-fired with combustible fluid fuel or heated by an electrical heating means such as sinuously-shaped resistor ribbons. Either inner or outer structure may be cylindrical, rectangular, or square in shape, as long as the outer structure encompasses the inner structure. In operation, the atmospheres within both inner and outer structures are closed to each other, and to the outside. Means are provided to control the atmosphere in both inner and outer structures. A sealable opening may be provided for access to a space within the inner cover of all bell annealing furnaces to facilitate the addition and removal of annealable substrate materials, or the inner and outer covers may simply be removed.

In some annealing furnaces, a vacuum can be drawn, and/or inert gasses may be provided within the inner structure and/or the outer structure depending on the annealing process desired. Apparatus may also be provided to hold the substrate materials within the inner structure. A base is typically provided in many embodiments to which both inner and outer covers are sealed. In these embodiments, the inner and/or outer covers are removable by lifting the bell furnace off of the base, for example, using a crane. Alternative embodiments provide for a sealable door in the side of the annealing furnace whether rectangular or cylindrical in shape. In the case of cylindrical shaped furnaces, the axis may be disposed parallel to the ground with an opening through a round end of the cylindrical furnace, the other end being closed.

A typical annealing furnace includes an outer furnace structure, a base which provides a support for the materials to be annealed, such as coils, and a bell cover which is placed over the coils within the furnace and sealed against the base or against the encompassing walls of the outer furnace to provide a sealed interior for circulation of a controlled atmosphere, such as an inert gas, as required for annealing or other processes. Hydrogen and nitrogen are considered inert gasses in these processes. A means, such as a fan, for circulating the gas within the bell cover is typically provided on, or in fluid communication through, the base. The encompassing outer furnace is heated either by electricity or gas combustion and is scaled over the bell cover sometimes sealing on the bell cover, and sometimes sealing on the base depending on configuration of the particular bell furnace. Alternative annealing structures provide for a plurality of inner covers to be disposed therein, or for a sealable door to replace the base.

In the manufacture of unidirectional electrical steel, batch annealing furnaces are in wide use for finish annealing (secondary recrystallization annealing). In these examples, a coil of electrical steel is placed, with the axis thereof vertical, on a base plate. An inner cover is placed over the coil, and a bell-shaped furnace lowered over the inner cover. An atmospheric gas, such as $N_2$, Ar, $H_2$ or the like, is supplied into the space under the inner cover through a feed pipe. At least one electric heater, or at least one gas burner, is disposed on the inside of the furnace to heat the gas/air between the inner wall of the furnace and the outer wall of the inner cover. An apparatus is provided to cool the heated air/gas in the furnace once the coil has been heated to a given temperature by communicating cool air/gas through the furnace between the inner wall of the furnace and the outer wall of the inner cover. This typically involves a cooling gas supply pipe connected to the top of the furnace and an exhaust of the heated cooling gas through a cooling device which then recirculates the cooled cooling gas through the furnace again.

In some embodiments of a bell annealing furnace, the furnaces are lined with refractory bricks, usually outer furnace, which may be tied together, affixed with mortar, or otherwise conventionally attached to the walls of the furnace or bell. Unfortunately, conventional refractory brick lining absorbs significant amounts of heat, lengthening the heat-up portion of the furnace cycle. Furthermore, conventional refractory bricks have high heat retention properties that tend to prolong the cool-down portion of the furnace cycle. Alternatives to refractory bricks include sheets, or panels of refractory materials, as well as other well known refractory materials. The base or door may also be lined with, or composed of, refractory materials.

There are significant temperature gradients between different locations of an annealing furnace structure. It is desirable to promote maximum air flow and circulation to prevent any hot spots or heat build-ups at elevated temperatures. To this end, attention has been given to improved seals between the outer furnace and the bell cover, and the base of the furnace, and improved atmosphere flow controls throughout. Additionally, many annealing processes require specific heat gradients to be maintained prior to a uniform cooling process. Alternative, conventional metal coil annealing furnaces may anneal a stationary coil placed on a base plate by using a given heat pattern to obtain a desired result.

An example of a conventional bell annealing furnace is shown in U.S. Pat. No. 2,283,982 assigned to Westinghouse Electric & Manufacturing Company on May 26, 1942, which teaches a bell type annealing furnace having a refractory-metal inner hood placed about a charge, the hood being encased by an outer insulating bell with sufficient clearance space between the hood and the interior of the bell to permit the disposition of heating means therein. This bell annealing furnace has a cylindrical formed hood and bell to aid in the even distribution of heat throughout the space between hood and bell.

An example of an annealing furnace used with a metal coil is shown in U.S. Pat. No. 4,502,671, which was assigned to Nippon Steel Corporation, issued on Mar. 5, 1985, and teaches another batch annealing apparatus consisting of a bell-shaped furnace, a base plate, and an inner cover. The apparatus therein also has a bottom chamber that opens upward, which has a diameter slightly larger than the outside diameter of a metal coil to be treated therein.

Various methods are used to seal the base or door, and to support the coils or other substrate to be annealed. U.S. Pat. No. 6,063,331, assigned to Rad-Con Incorporated and issued on May 16, 2000, teaches a bell type annealing furnace structure which includes a base with a base plate member and an annular channel therearound. A plurality of enclosure members having a coil support section with support legs depending therefrom supporting the enclosure member on the base plate member and defining a space between the base plate member and the coil support section. An improved seal arrangement is contemplated in which the seal uses a wire mesh with enclosed ceramic fibers.

U.S. Pat. No. 4,504,957 issued on Mar. 12, 1985 and assigned to Armco Inc. teaches a high temperature box annealing furnace for metallic coil annealing practices. That furnace has a fixed base and a removal bell capable of achieving a sealed relationship with the base. The interior of the bell side walls, end walls and roof are lined with ceramic fiber insulation and are provided with electrical resistance heating elements. The base has a steel framework supporting a cast refractory base member configured to support one or more coils. Each coil is provided with a cover and the cast refractory member provides a sand, water and/or sand seal for the lower edge of the covers. Multiple inner covers are used simultaneously within the same furnace. Cooling capacity is provided by inlets and outlets for appropriate cooling gas. The base is ceramic eliminating the metallic coil-supporting base plates of other furnaces. Furthermore, fiber insulation is provided within the bell in an effort to reduce heat up and cool down portions of the furnace cycle.

SUMMARY OF THE INVENTION

The surfaces of a bell annealing furnace, according to alternative embodiments of the present invention, have at least one thermal protective coating disposed at least partially thereon to increase production and reduce the energy costs associated with annealing a material. A bell annealing furnace has an outer furnace cover encompassing at least one inner cover. Each inner cover has inner and outer surfaces with a space within the inner cover to receive an annealable material therein. A conventional heating means, either combustion or electrical, is disposed within the outer furnace cover to heat the outer surface of the inner cover. Either a door or a base for sealing the inner cover and the outer furnace cover is also provided.

The thermal protective layer is, at least partially, disposed on a substrate surface within the bell annealing furnace. Such substrate surfaces include surfaces of the outer furnace cover, including the internal surface thereof and the components of the heating means. The inner surface of the inner cover, and the outer surface of the inner cover, may alternatively or additionally have a thermal protective layer disposed thereon.

The substrate surface may be a metallic surface, a ceramic surface, or combinations thereof. The thermal protective layer has (a) from about 5% to about 30% of an inorganic adhesive, from about 45% to about 92% of a filler, and from about 1% to about 20% of one or more emissivity agents, or (b) from about 5% to about 35% of colloidal silica, colloidal alumina, or combinations thereof, from about 23% to about 79% of a filler, and from about 1% to about 20% of one or more emissivity agents.

An aspect of the present invention is that the thermal protective layer aids in controlling the thermal parameters of the furnace. Different annealable materials require different gradients of heat to properly anneal the material for the desired thermal property. The present invention facilitates controlling the heating, and/or cooling, pattern of the bell annealing furnace.

Another aspect of the present invention is that the overall cost of operating the bell annealing furnace is reduced. The thermal protective layer protects the underlying substrate material, whether metal or ceramic, and increases the useful life of the substrate surface. Downtime for maintenance and cleaning the furnace is thereby reduced.

A further aspect of the present invention is reduced energy consumption. The bell annealing furnace according to the present invention requires a lower amount of energy input to generate the same amount of heat within the furnace.

Yet another aspect of the present invention is that it may reduce heat retention or absorption of the underlying substrate layers further facilitating control of the heating paradigm of the bell annealing furnace. Surfaces having a thermal protective layer disposed thereon may not become as heated and therefore may not retain as much heat allowing quicker cooling and heating cycles which can result in decreased annealing cycle times in heat up or cool down.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Figure 1A:
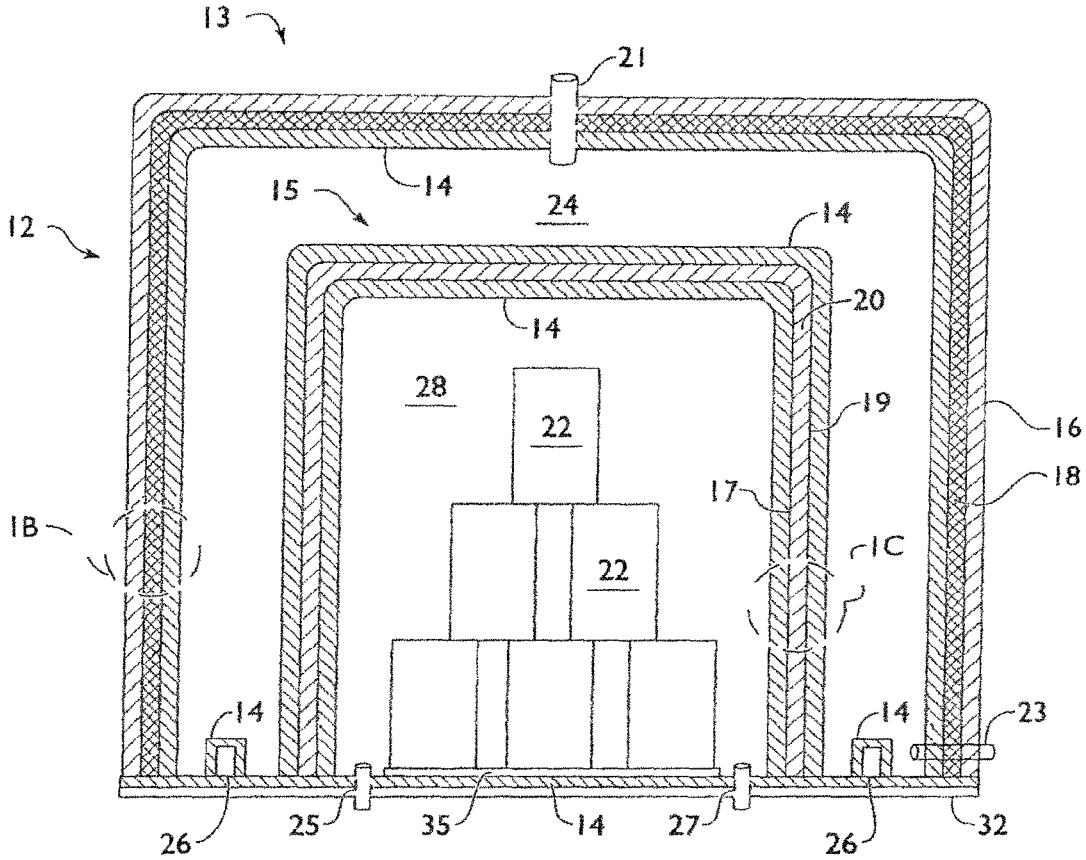
FIG. 1A is a schematic side view of a bell annealing furnace according to an embodiment of the present invention.

Similar reference characters denote corresponding features consistently throughout the attached drawings. The present invention is not limited to the embodiments demonstrated in the drawings but includes any bell annealing furnace incorporating a thermal protective layer according to the present invention therein.

DETAILED DESCRIPTION OF PREFERRED EMBODIMENTS

Figure 1B:
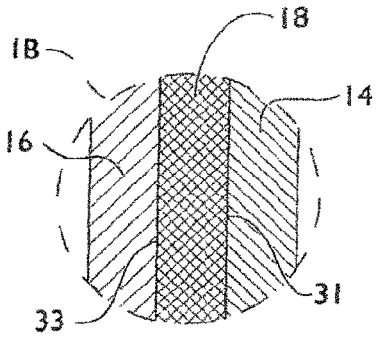
FIG. 1B is a schematic representation of part of an outer furnace cover having a protective layer disposed on the inner surface thereof which is part of the bell annealing furnace shown in FIG. 1A.
Figure 1C:
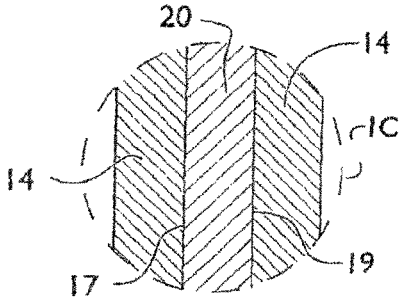
FIG. 1C is a schematic representation of part of an inner cover having protective layers disposed on the outer and inner surfaces thereof which is a part of the bell annealing furnace shown in FIG. 1A.

A bell annealing furnace 12 according to an embodiment of the present invention is shown schematically in FIG. 1A. The bell annealing furnace 12 has an outer furnace cover 13 encompassing at least one inner cover 15. The outer furnace cover 13, as shown in the embodiment of FIGS. 1A and 1B, has a refractory material 18 disposed on the inner surface 33 of the outer furnace cover's wall 16 forming a refractory substrate surface 31. The outer furnace cover 13 may be metal with refractory interior, as shown in FIGS. 1A and 1B. Each inner cover 15 has inner and outer surfaces 17 and 19 forming a space 28 within the inner cover 15 to receive an annealable material 22 therein, as shown in FIGS. 1A and 1C.

A heating means is disposed within the outer furnace cover 13 to heat the outer surface 19 of the inner cover 15. The heating means shown in FIG. 1 has burner tips 26 disposed in a space 24 between the inner cover 15 and the outer furnace cover 13. The burner tips 26 are used to communicate ignited or hot fluid, as is well known in the art, into the furnace space 24 to increase the temperature therein resulting in heating the outer surface 19 of the inner cover 15. A means for cooling the furnace space 24 is also provided, and may consist of inlets 21 and outlets 23 for cycling cooling fluids therethrough, as is also well known in the art of bell annealing. In some embodiments of the present invention the inlets 21 and outlets 23 may be used to cycle both cooling and heating fluids through the furnace space 24 to control the paradigm of heat along the outer surface 19 of the inner cover 15. The term "fluids" as used herein includes gasses, liquids, and fluidic pulverized solids which are conventionally used in heating furnaces.

A means for sealing the inner cover 15 and the outer furnace cover 13 includes a base 32, as schematically depicted in FIG. 1A. Alternatively the means for sealing the inner cover 15 and outer furnace cover 13 includes a base detachably fixed to and upon which the inner cover 15 and the outer furnace cover 13 rest, a base 32 upon which the inner cover 15 is detachably fixed with the outer furnace cover 13 detachably sealed to the inner cover 15, a base 32 upon which the outer furnace cover 13 rests while the inner cover 15 is detachably sealed to the outer furnace cover 13, or a sealable door affixed to the furnace and disposed to facilitate access through the outer furnace cover 13 to the space 28 within the inner cover 15. Details of these alternative base 32 or door are not shown in the drawings because they are well known in the art. The thermal protective layer 14 of the present invention may be disposed on refractory and/or metallic surfaces of the base 32/door.

The base 32 may also contain inlets 25 and outlets 27 permitting control of the atmosphere within the inner cover 13. The annealable material 22 may be stacked up on the base 32 or on a special holder (not shown) as well known in the art. Furthermore, the burners 26 may be disposed in the base 32, as well. The surfaces of the burners 26 may have a thermal protective layer 14 at least partially disposed thereon.

The predominant differences between a door and a base, as used in conventional bell annealing furnaces, is whether the furnace sits upon the base or has a door disposed in the side thereof. Smaller bell annealing furnaces, including table top models, may provide access through a door. Larger bell annealing furnaces, including industrial production furnaces, may have a bell that is accessed by lifting the entire furnace off of the base or through openings disposed in the base, i.e., through the floor.

At least one thermal protective layer 14 is at least partially disposed on a substrate surface within the bell annealing furnace 12 according to each alternative embodiment of the present invention. Substrate surfaces may be metallic, including well known metal alloys traditionally used in the construction of bell annealing furnaces, or ceramic, including well known refractory materials such as refractory brick, panels, cement, glue and the like. Specifically, substrate surfaces include a surface of the outer furnace cover, a surface of the base or door, a surface of the heating means, the inner surface of the inner cover, the outer surface of the inner cover, or combinations thereof. In FIG. 1, the inner cover 15 is composed of a metallic wall 20.

Figure 2:
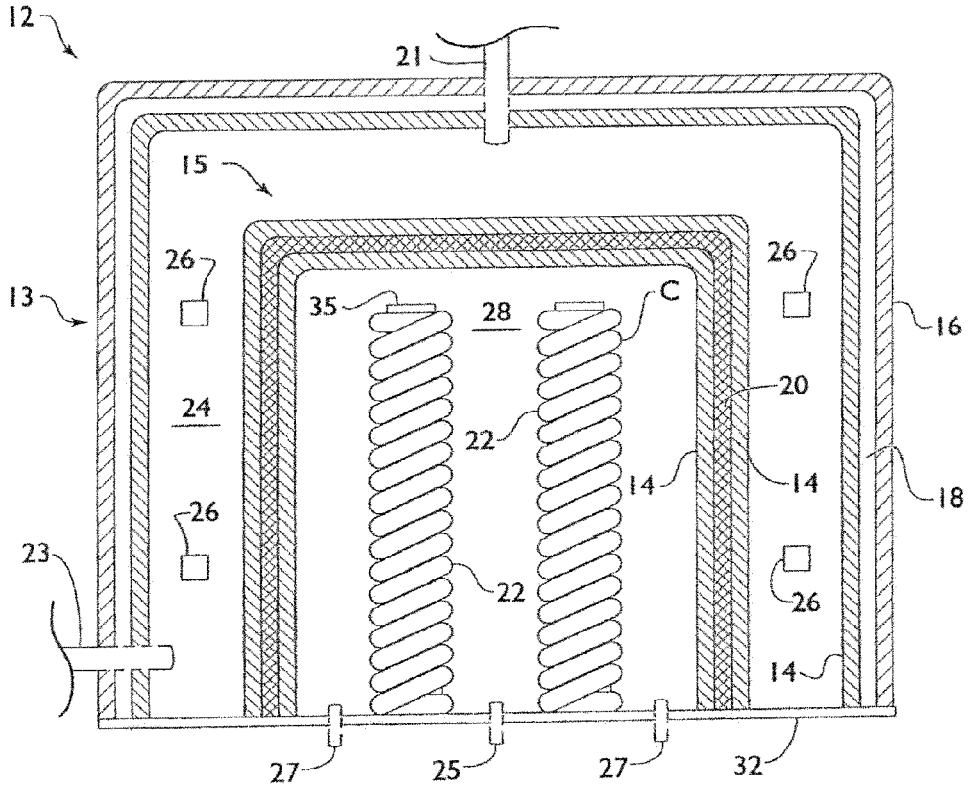
FIG. 2 is a schematic side view of a bell annealing furnace according to an embodiment of the present invention.
Figure 3:
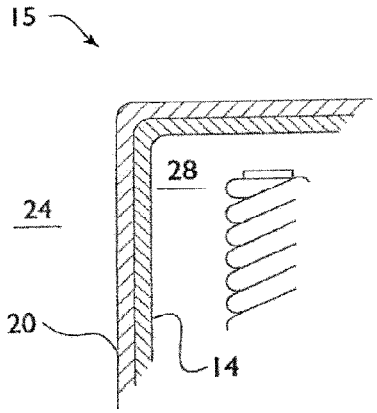
FIG. 3 is a schematic representation of part of an alternative embodiment of an inner cover according to an embodiment of the present invention having a thermal protective layer disposed on the inside thereof.
Figure 4:
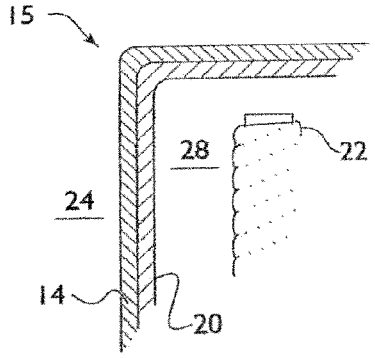
FIG. 4 is a schematic representation of part of an alternative embodiment of an inner cover according to an embodiment of the present invention having a thermal protective layer disposed on the outside thereof.

FIG. 1A shows a thermal protective layer 14 disposed on a surface 31 of a refractory material 18 that has been placed on the surface 33, shown in FIG. 1B, of the inner wall 16 of the outer furnace 13. The thermal protective layer 14, in FIGS. 1A and 1C, is disposed on both inner and outer surfaces 17 and 19 of the inner cover's 15 metal wall 20. Furthermore, in FIG. 1A, a thermal protective layer 14 is disposed on the base 32 and on the burners 26. Alternatively, as shown in FIG. 2, the thermal protective layer 14 may be disposed only on the walls, as shown, and not on the base 32, or the protective layer may be disposed on the inner surface 17 of the inner cover 15, as shown in FIG. 3, or on the outer surface 19 of the inner cover 15, as shown in FIG. 4.

Each substrate surface within the bell annealing furnace 12 according to the present invention is metallic, ceramic, or combinations thereof. The thermal protective layer 14 comprises from about 5% to about 30% of an inorganic adhesive, from about 45% to about 92% of a filler, and from about 1% to about 20% of one or more emissivity agents; or from about 5% to about 35% of colloidal silica, colloidal alumina, or combinations thereof, from about 23% to about 79% of a filler, and from about 1% to about 20% of one or more emissivity agents.

The heating means disposed within the outer furnace cover 13 is typically either an electrical heating source or a flammable gas burner. Alternative heating means are also known, and are included herein. The bell annealing furnaces 12 according to the present invention may have a heating means that utilizes at least one electrical resistant element 30.

As used herein, the term "electrical resistant element" includes electrical coils, radiant tubes, or the like, as are well known in the art of electrical powered heating, whether the heating means uses induction or convection, or the like as are also well known in the art of electrical powered furnaces. Induction heating apparatuses use electrical resistant elements to heat adjacent material whereas convection heating apparatuses use fluid flow to circulate heat generated in a fluid medium, such as air. Alternative examples of electrical heaters may include convection paradigms where heat from an electrical element, including electrical coils, radiant tubes, and the like, is moved by a fan, or other means to circulate heated air, fluids to heat the outer surface of the inner cover 15. Different annealing procedures may require different gradients or paradigms of heat application to the annealable material in order to depart the desired traits thereto. Because of this requirement a large variety of heating, and cooling, procedures are deployed.

The annealable material 22 disposed within the space 28 in the inner cover 15 may be placed on the base 32 directly or on a support member 35 designed to hold the annealable material according to the design of the bell annealing furnace 12, as shown in FIGS. 1A, 2, 3, and 4, where a coil support member 35 is depicted holding the coil 22. A coil support member may be disposed within the inner space to hold the annealable material thereon. The coil support member may have a thermal protective layer disposed thereon. A variety of coil support member designs are well known in the art, and are incorporated herein.

Figure 5A:
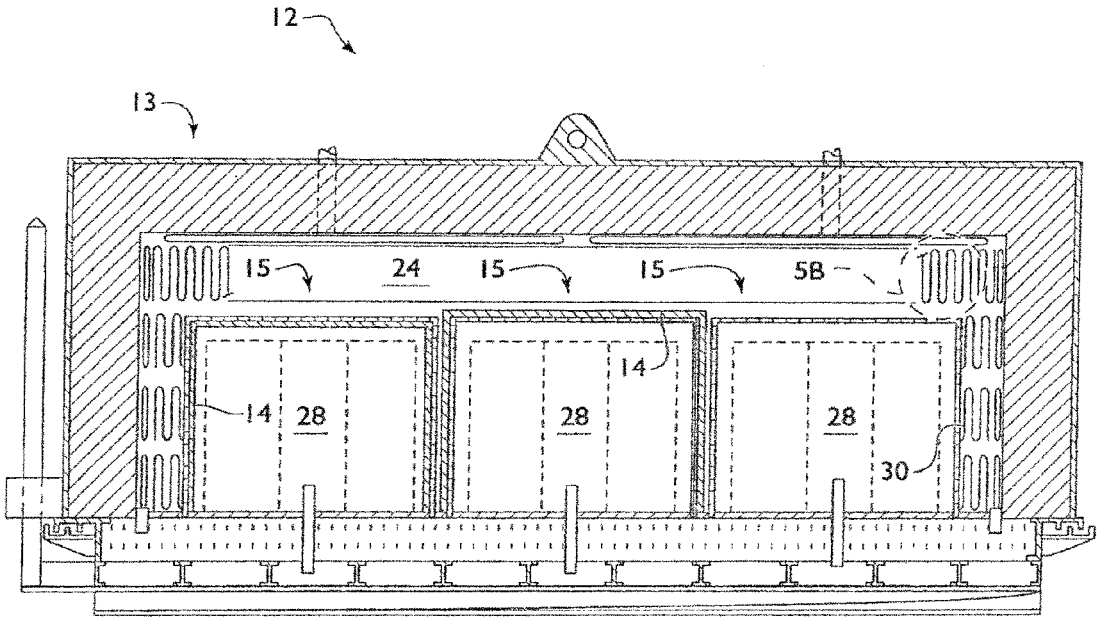
FIG. 5A is a schematic side view of a bell annealing furnace according to an embodiment of the present invention.
Figure 5B:
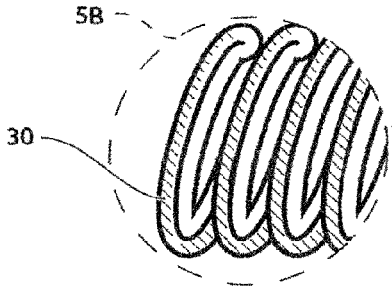
FIG. 5B is a schematic view of a part of the heating elements of an embodiment of the present invention depicted in FIG. 5A.

The embodiment of the bell annealing furnace as shown in FIGS. 5A and 5B has electrical heat resisting elements 30, which may be encased in an insulating material, and more than one inner cover 15 disposed adjacent other inner covers 15 encompassed within a single outer furnace cover 13.

In some embodiments of the present invention, refractory material forms at least a surface disposed within the furnace. Refractory surfaces 18 may be found on a surface of the outer furnace cover 13, on the inner surface of the inner cover 15, on the outer surface of the inner cover 15, on the base 32, on the door, on the means for holding the annealable material 35, or on combinations thereof. Where refractory materials are used in a bell annealing furnace 12 according to alternative embodiments of the present invention, a thermal protective layer 14 may be disposed at least partially on a refractory surface thereof.

Surfaces within the bell annealing furnace 12 may include a metallic surface. The metallic surface which may form at least a surface disposed within the furnace comprised of iron, aluminum, alloys, steel, cast iron, stainless steel, and combinations thereof. The thermal protective coating may be disposed, at least partially, on such a metallic surface within the bell annealing furnace.

A fan motor, which is not shown in the drawings, maybe disposed within the base or in fluid communication therewith to circulate gases within the inner cover when the inner cover is in position and sealed to the base/furnace. A fan shaft may extend between the base and an atmospheric source through the base. The circulation of a controlled atmosphere within the inner cover is well known in the art using fans and fan motors and the like. Insulating material, such as ceramic fibers, may be used in the furnace, the base, the inner cover, and/or the seals therebetween. An annular water channel may be provided within the inner cover to facilitate water drainage during cooling as is well known in the art, which may also act against an insulating seal. The furnace also is provided in a well known manner with burners which can be connected to gas connections and may have recuperators (also not shown) attached thereto which in a well known manner reheat the air for combustion.

In operation, a coil support member 35 is placed upon the base and coils are stacked on the support member, as schematically shown in the drawings. The coils may be separated by coil plates or supports. The inner cover 15 is positioned over the base 32 enclosing the coils 22. The bell member of the inner cover 15 rests upon the base 32. Hydraulic or pneumatic pressure is applied to aid the sealing of the inner cover 15 such that the interior of the bell shaped cover is essentially sealed from ambient around the outer periphery thereof. The furnace member 13 is placed over and encompassing the inner cover. The furnace 12 may then be heated to the temperature required to anneal the coil.

In many annealing operations, the coils must be protected from oxidation which is accomplished by recirculating inert gas such as hydrogen, argon, or nitrogen inside the cover by means of the fan. This causes an increase in the temperature of various parts of the furnaces structure.

The thermal protective layer 18 may be applied as a high emissivity multifunctional thermal protective coating. Suitable coatings and methods of application are described in U.S. Pat. Nos. 7,105,047 and 6,921,431 and assigned to Wessex Incorporated, the contents of which are incorporated herein in their entirety.

A high emissivity coating suitable for forming a thermal protective layer on a metal/alloy process tube assembly of the present invention may contain from about 5% to about 30% of an inorganic adhesive, from about 45% to about 92% of a filler, and from about 1% to about 20% of one or more emissivity agents, in a dry admixture. Preferably, the dry admixture also contains from about 1% to about 5% of a stabilizer.

An alternative high emissivity coating suitable for forming a thermal protective layer on a ceramic process tubes and assembly, and on ceramic refractory wall materials, including brick, castable and ceramic fiber refractory walls, according to an embodiment of the present invention may contain from about 5% to about 35% of colloidal silica, from about 23% to about 79% of a filler, from about 1% to about 20% of one or more emissivity agents. Preferably, a thermal protective layer of the present invention also contains from about 1.5% to about 5.0% of a stabilizer.

As used herein, all percentages (%) are percent weight-to-weight, also expressed as weight/weight %, % (w/w), w/w, w/w % or simply %, unless otherwise indicated. Also, as used herein, the terms "wet admixture" refers to relative percentages of the composition of the thermal protective coating in solution and "dry admixture" refers to the relative percentages of the composition of the dry thermal protective coating mixture prior to the addition of water. In other words, the dry admixture percentages are those present without taking water into account. Wet admixture refers to the admixture in solution (with water). "Wet weight percentage" is the weight in a wet admixture, and "dry weight percentage" is the weight in a dry admixture without regard to the wet weight percentages. The term "total solids", as used herein, refers to the total sum of the silica/alumina and the alkali or ammonia ($NH_3$), plus the fraction of all solids including impurities. Weight of the solid component divided by the total mass of the entire solution, times one hundred, yields the percentage of "total solids".

Method of preparation of coating involves applying a wet admixture of the coating to the surface to be coated. Alternative methods may include spraying the wet admixture on the surface or atomizing the dry admixture and coating the surface accordingly.

In a coating solution according to the present invention, a wet admixture of the thermal protective coating, to be applied to metal/alloy process tubes/assembly, contains from about 6% to about 40% of an inorganic adhesive, from about 23% to about 46% of a filler, from about 0.5% to about 10% of one or more emissivity agents, and from about 18% to about 50% water. In order to extend the shelf life of the coating solution, from about 0.5% to about 2.5% of a stabilizer is preferably added to the wet admixture. The wet admixture coating solution contains between about 40% and about 60% total solids.

In a coating solution according to the present invention, a wet admixture of an alternative thermal protective coating, to be applied to the refractory structure and ceramic process tubes/assembly, contains from about 15% to about 45% of colloidal silica, from about 23% to about 55% of a filler, from about 0.5% to about 10% of one or more emissivity agents, from about 0.5% to about 2.5% of a stabilizer and from about 18% to about 40% water. The wet admixture coating solution contains between about 40% and about 70% total solids.

The inorganic adhesive is preferably an alkali/alkaline earth metal silicate taken from the group consisting of sodium silicate, potassium silicate, calcium silicate, and magnesium silicate. The colloidal silica is preferably a mono-dispersed distribution of colloidal silica, and therefore, has a very narrow range of particle sizes. The filler is preferably a metal oxide taken from the group consisting of silicon dioxide, aluminum oxide, titanium dioxide, magnesium oxide, calcium oxide and boron oxide. The emissivity agent(s) is preferably taken from the group consisting of silicon hexaboride, carbon tetraboride, silicon tetraboride, silicon carbide, molybdenum disilicide, tungsten disilicide, zirconium diboride, cupric chromite, and metallic oxides such as iron oxides, magnesium oxides, manganese oxides, copper chromium oxides, and chromium oxides, cerium oxides, and terbium oxides, and derivatives thereof. The copper chromium oxide, as used in the present invention, is a mixture of cupric chromite and cupric oxide. The stabilizer may be taken from the group consisting of bentonite, kaolin, magnesium alumina silica clay, tabular alumina and stabilized zirconium oxide. The stabilizer is preferably bentonite. Other ball clay stabilizers may be substituted herein as a stabilizer. Colloidal alumina, in addition to or instead of colloidal silica, may also be included in the admixture of the present invention. When colloidal alumina and colloidal silica are mixed together one or the other requires surface modification to facilitate mixing, as is known in the art.

Coloring may be added to the protective coating layer of the present invention to depart coloring to the tubes. Inorganic pigments may be added to the protective coating without generating toxic fumes. In general, inorganic pigments are divided into the subclasses: colored (salts and oxides), blacks, white and metallic. Suitable inorganic pigments include but are not limited to yellow cadmium, orange cadmium, red cadmium, deep orange cadmium, orange cadmium lithopone and red cadmium lithopone.

A preferred embodiment of the present invention contains a dry admixture of from about 10% to about 25% sodium silicate, from about 50% to about 79% silicon dioxide powder, and from about 4% to about 15% of one or more emittance agent(s) taken from the group consisting of iron oxide, boron silicide, boron carbide, silicon tetraboride, silicon carbide molybdenum disilicide, tungsten disilicide, zirconium diboride. Preferred embodiments of the thermal coating may contain from about 1.0% to about 5.0% bentonite powder in dry admixture. The corresponding coating in solution (wet admixture) for this embodiment contains from about 10.0% to about 35.0% sodium silicate, from about 25.0% to about 50.0% silicon dioxide, from about 18.0% to about 39.0% water, and from about 1.0% to about 8.5% one or more emittance agent(s). This wet admixture must be used immediately. In order to provide a coating solution admixture (wet admixture), which may be stored and used later, preferred embodiments of the thermal coating contain from about 0.25% to about 2.50% bentonite powder. Preferably deionized water is used. Preferred embodiments of the wet admixture have a total solids content ranging from about 45% to about 55%.

A preferred thermal protective coating of the present invention contains a dry admixture from about 15.0% to about 20.0% sodium silicate, from about 69.0% to about 79.0% silicon dioxide powder, about 1.00% bentonite powder, and from about 5.00% to about 15.0% of an emittance agent. The emittance agent is taken from one or more of the following: iron oxide, boron silicide, molybdenum disilicide, tungsten disilicide, and boron carbide.

A most preferred wet admixture contains about 20.0% sodium silicate based on a sodium silicate solids content of about 37.45%, from about 34.5% to about 39.5% silicon dioxide powder, about 0.500% bentonite powder, and from about 2.50% to about 7.5% of an emittance agent, with the balance being water. The emittance agent is most preferably taken from the group consisting of iron oxide, boron silicide, and boron carbide (also known as, carbon tetraboride). Preferred embodiments include those where the emittance agent comprises about 2.50% iron oxide, about 2.50% to about 7.5% boron silicide, or from about 2.50% to about 7.50% boron carbide. The pH of a most preferred wet admixture according to the present invention is about 11.2±1.0, the specific gravity is about 1.45±0.05 and the total solids content is about 50±0.3%.

A preferred embodiment of the present invention contains a dry admixture of from about 10.0% to about 30.0% colloidal silica, from about 50% to about 79% silicon dioxide powder, and from about 2% to about 15% of one or more emittance agent(s) taken from the group consisting of cerium oxide, boron silicide, boron carbide, silicon tetraboride, silicon carbide molybdenum disilicide, tungsten disilicide, zirconium diboride, and from about 1.5% to about 5.0% bentonite powder. The corresponding coating in solution (wet admixture) for this embodiment contains from about 20.0% to about 35.0% colloidal silica, from about 25.0% to about 55.0% silicon dioxide, from about 18.0% to about 35.0% water, and from about 2.0% to about 7.5% one or more emittance agent (s), and from about 0.50% to about 2.50% bentonite powder. Preferably deionized water is used. Preferred embodiments of the wet admixture have a total solids content ranging from about 50% to about 65%.

A most preferred thermal protective coating of the present invention contains a dry admixture from about 15.0% to about 25.0% colloidal silica, from about 68.0% to about 78.0% silicon dioxide powder, about 2.00% to about 4.00% bentonite powder, and from about 4.00% to about 6.00% of an emittance agent. The emittance agent is taken from one or more of the following: zirconium boride, boron silicide, and boron carbide.

A most preferred wet admixture contains about 27.0% colloidal silica based on a colloidal silica solids content of about 40%, from about 25% to about 50% silicon dioxide powder, about 1.50% bentonite powder, and from about 2.50% to about 5.50% of an emittance agent, with the balance being water. The emittance agent is most preferably taken from the group consisting of zirconium boride, boron silicide, molybdenum disilicide, tungsten disilicide, and boron carbide. Preferred embodiments include those where the emittance agent comprises about 2.50% zirconium diboride, about 2.50% boron silicide, or from about 2.50% to about 7.50% boron carbide. The specific gravity of a most preferred wet admixture is about 1.40 to 1.50 and the total solids content is about 50% to 60%.

An inorganic adhesive, which may be used in the present invention, includes N (trademark) type sodium silicate that is available from the PQ Corporation (of Valley Forge, Pa.). Sodium silicates ($Na_2O.XSiO_2$) are metal oxides of silica. All soluble silicates can be differentiated by their ratio, defined as the weight proportion of silica to alkali ($SiO_2/Na_2O$). Ratio determines the physical and chemical properties of the coating. The glassy nature of silicates imparts strong and rigid physical properties to dried films or coatings. Silicates air dry to a specific moisture level, according to ambient temperature and relative humidity. Heating is necessary to take these films to complete dryness—a condition in which silicates become nearly insoluble. Reaction with other materials, such as aluminum or calcium compounds, will make the film coating completely insoluble. The N (trademark) type sodium silicate, as used in the examples below, has a weight ratio SiO-.sub.2/Na.sub.2O is 3.22, 8.9% Na.sub.2O, 28.7% SiO.sub.2, with a density (at room temperature of 20° C.) of 41.0°Be', 11.6 lb/gal or 1.38 g/cm.sup.3. The pH is 11.3 with a viscosity of 180 centipoises. The N type sodium silicate is in a state of a syrupy liquid.

The term "total solids" refers to the sum of the silica and the alkali. The weight ratio is a most important silicate variable. Ratio determines the product solubility, reactivity and physical properties. Ratio is either the weight or molar proportion of silica to alkali. Density is an expression of total solids and is typically determined using a hydrometer or pycnometer Ludox (trademark) TM 50 colloidal silica and Ludox (trademark) AS 40 colloidal silica are available from Grace Davidson (of Columbia, Md.). The particles in Ludox (trademark) colloidal silica are discrete uniform spheres of silica which have no internal surface area or detectable crystallinity. Most are dispersed in an alkaline medium which reacts with the silica surface to produce a negative charge. Because of the negative charge, the particles repel one another resulting in stable products. Although most grades are stable between pH 8.5-11.0, some grades are stable in the neutral pH range. Ludox (trademark) colloidal silicas are aqueous colloidal dispersions of very small silica particles. They are opalescent to milky white liquids. Because of their colloidal nature, particles of Ludox (trademark) colloidal silica have a large specific surface area which accounts for the novel properties and wide variety of uses. Ludox (trademark) colloidal silica is available in two primary families: mono-dispersed, very narrow particle size distribution of Ludox (trademark) colloidal silica and poly-dispersed, broad particle size distribution of Ludox (trademark) P. The Ludox (trademark) colloidal silica is converted to a dry solid, usually by gelation. The colloidal silica can be gelled by (1) removing water, (2) changing pH, or (3) adding a salt or water-miscible organic solvent. During drying, the hydroxyl groups on the surface of the particles condense by splitting out water to form siloxane bonds (Si—O—Si) resulting in coalescence and interbonding. Dried particles of Ludox (trademark) colloidal silica are chemically inert and heat resistant. The particles develop strong adhesive and cohesive bonds and are effective binders for all types of granular and fibrous materials, especially when use at elevated temperature is required.

Colloidal alumina is available as Nyacol (trademark) colloidal alumina, and specifically, Nyacol (trademark) AL20, available from Nyacol Nano Technologies, Inc. (Ashland, Mass.), and is available in deionized water to reduce the sodium and chlorine levels to less than 10 ppm. It contains about 20 percent by weight of $AL_2O_3$, a particle size of 50 nm, positive particle charge, pH 4.0, specific gravity of 1.19, and a viscosity of 10 cPs.

The filler may be a silicon dioxide powder such as Min-U-Sil (trademark) 5 silicon dioxide available from U.S. Silica (of Berkeley Springs, W. Va.). This silicon dioxide is fine ground silica. Chemical analysis of the Min-U-Sil (trademark) silicon dioxide indicates contents of 98.5% silicon dioxide, 0.060% iron oxide, 1.1% aluminum oxide, 0.02% titanium dioxide, 0.04% calcium oxide, 0.03% magnesium oxide, 0.03% sodium dioxide, 0.03% potassium oxide and a 0.4% loss on ignition. The typical physical properties are a compacted bulk density of 41 lbs/ft.sup.3, an uncompacted bulk density of 36 lbs/$ft^3$, a hardness of 7 Mohs, hegman of 7.5, median diameter of 1.7 microns, an oil absorption (D-1483) of 44, a pH of 6.2, 97%-5 microns, 0.005%+325 Mesh, a reflectance of 92%, a 4.2 yellowness index and a specific gravity of 2.65.

Emittance agents are available from several sources. Emissivity is the relative power of a surface to absorb and emit radiation, and the ratio of the radiant energy emitted by a surface to the radiant energy emitted by a blackbody at the same temperature. Emittance is the energy reradiated by the surface of a body per unit area.

The boron carbide, also known as carbon tetraboride, which may be used as an emissivity agent in the present invention, is sold as 1000 W boron carbide and is available from Electro Abrasives (of Buffalo, N.Y.). Boron Carbide is one of the hardest man made materials available. Above 1300° C., it is even harder than diamond and cubic boron nitride. It has a four point flexural strength of 50,000 to 70,000 psi and a compressive strength of 414,000 psi, depending on density. Boron Carbide also has a low thermal conductivity (29 to 67 W/mK) and has electrical resistivity ranging from 0.1 to 10 ohm-cm. Typical chemical analysis indicates 77.5% boron, 21.5% carbon, iron 0.2% and total Boron plus Carbon is 98%. The hardness is 2800 Knoop and 9.6 Mohs, the melting point is 4262° F. (2350° C.), the oxidation temperature is 932° F. (500° C.), and the specific gravity is 2.52 g/cc.

1000 W green silicon carbide (SiC), an optional emissivity agent, is also available from Electro Abrasives. Green Silicon Carbide is an extremely hard (Knoop 2600 or Mohs 9.4) man made mineral that possesses high thermal conductivity (100 W/m-K). It also has high strength at elevated temperatures (at 1100° C., Green SiC is 7.5 times stronger than $Al_2O_3$). Green SiC has a Modulus of Elasticity of 410 GPa, with no decrease in strength up to 1600° C., and it does not melt at normal pressures but instead dissociates at 2815.5° C. Green silicon carbide is a batch composition made from silica sand and coke, and is extremely pure. The physical properties are as follows for green silicon carbide: the hardness is 2600 Knoop and 9.4 Mohs, the melting point is 4712° F. (2600° C.), and the specific gravity is 3.2 g/cc. The typical chemical analysis is 99.5% SiC, 0.2% $SiO_2$, 0.03% total Si, 0.04% total Fe, and 0.1% total C. Commercial silicon carbide and molybdenum disilicide may need to be cleaned, as is well known in the art, to eliminate flammable gas generated during production.

Boron silicide ($B_6Si$) is available from Cerac (of Milwaukee, Wis.). The boron silicide, also known as silicon hexaboride, available from Cerac has a −200 mesh, and a typical purity of about 98%. Zirconium boride ($ZrB_2$) is also available from Cerac with a typical average of 10 microns or less (−325 mesh), and a typical purity of about 99.5%.

Iron oxide available from Hoover Color (of Hiwassee, Va.) is a synthetic black iron oxide ($Fe_2O_3$) which has an iron oxide content of 60%, a specific gravity of 4.8 gm/cc, a tap density (also known as, bulk density) of 1.3 gm/cc, oil absorption of 15 lbs/100 lbs, a 325 mesh residue of 0.005, and a pH ranging from 7 to 10.

Preferably the admixture of the present invention includes bentonite powder, tabular alumina, or magnesium alumina silica clay. The bentonite powder permits the present invention to be prepared and used at a later date. Preparations of the present invention without bentonite powder must be used immediately. The examples provided for the present invention include PolarGel bentonite powder are available from Mineral and Pigment Solutions, Inc. (of South Plainfield, N.J.). Technical grade bentonite is generally used for the purpose of suspending, emulsifying and binding agents, and as Theological modifiers. The typical chemical analysis 59.00% to 61.00% of silicon dioxide ($SiO_2$), 20.00% to 22.00% of aluminum oxide ($Al_2O_3$), 2.00% to 3.00% calcium oxide (CaO), 3.50% to 4.30% magnesium oxide (MgO), 0.60% to 0.70% ferric oxide ($Fe_2O_3$), 3.50% to 4.00% sodium oxide ($Na_2O$), 0.02% to 0.03% potassium oxide ($K_2O$), and 0.10% to 0.20% titanium dioxide and a maximum of 8.0% moisture. The pH value ranges from 9.5 to 10.5. Typical physical properties are 83.0 to 87.0 dry brightness, 2.50 to 2.60 specific gravity, 20.82 pounds/solid gallon, 0.0480 gallons for one pound bulk, 24 ml minimum swelling power, maximum 2 ml gel formation, and 100.00% thru 200 mesh. Tabular alumina (Alumina Tab T64 Item 635) and magnesium alumina silica clay (Mag Alum Sil Technical Item 105) are also available from Mineral and Pigment Solutions, Inc.

Colorants, which may be added to the present invention, include but are not limited to inorganic pigments. Suitable inorganic pigments, such as yellow iron oxide, chromium oxide green, red iron oxide, black iron oxide, titanium dioxide, are available from Hoover Color Corporation. Additional suitable inorganic pigments, such as copper chromite black spinel, chromium green-black hematite, nickel antimony titanium yellow rutile, manganese antimony titanium buff rutile, and cobalt chromite blue-green spinel, are available from The Shepherd Color Company (of Cincinnati, Ohio).

A surfactant may be added to the wet admixture prior to applying the thermal protective layer to the support layer. The surfactant was Surfyonol (trademark) 465 surfactant available from Air Products and Chemicals, Inc. (of Allentown, Pa.). The Surfyonol (trademark) has a chemical structure of ethoxylated 2,4,7,9-tetramethyl 5 decyn-4,7-diol. Other surfactants may be used, such as STANDAPOL (trademark) T, INCI which has a chemical structure of triethanolamine lauryl sulfate, liquid mild primary surfactant available from Cognis-Care Chemicals (of Cincinnati, Ohio). The amount of surfactant present by weight in the wet admixture in from about 0.05% to about 0.2%.

The thermal protective coating is applied to the surface to form a thermal protective layer. The substrate surface may be a metallic substrate such as iron, aluminum, alloys, steel, cast iron, stainless steel and the like, or it may be a ceramic surface, as is well known in the art. The coating is typically applied wet, and either allowed to air dry or heat dry.

Surface preparation for metal or ceramic structures are similar. The surface should be clear of all dirt, loose material, surfactants, oils, gasses, etc. A metal surface may be grit blasted. Grit blasting is desirable to remove oxidation and other contaminants for metal surfaces only. Grits media should be sharp particles. Gun pressure will vary depending on the cut type, condition of the metal and profile desired. Very old metal will require 70-80 psi. Oil and water-free compressed air is required. Proper filters for the removal of oil and water are required. Other alkaline type metal cleanses may also be utilized.

After the grit blast, the surface should be thoroughly cleaned to remove all loose particles with clean oil and water free air blasts. Avoid contaminating surface with fingerprints. Acetone can be used (under proper ventilation and exercising all necessary precautions when working with acetone) on a clean cloth to wipe metallic surfaces clean. A cleaning compound may be used on certain stainless steel in lieu of grit blasting. Dirlum available from Blue Wave Ultrasonics (of Davenport, Iowa), a powdered alkaline cleaner, may be used in cleaning metal surface.

When using the wet admixture containing a stabilizer, solids may settle during shipment or storage. Prior to use all previously mixed coating must be thoroughly re-mixed to ensure all settled solids and clumps are completely re-dispersed. When not using a stabilizer, the coating may not be stored for any period of time. In any case, the coating should be used immediately after mixing to minimize settling.

Mixing instructions for one and five gallon containers. High speed/high shear saw tooth dispersion blade 5" diameter for one gallon containers and 7" diameter for five gallon containers may be attached to a hand drill of sufficient power with a minimum no load speed of 2000 rpm shear. Dispersion blades can be purchased from numerous suppliers. Mix at high speed to ensure complete re-dispersion for a minimum of 30 minutes.

The product should be applied directly after cleaning a metal surface so minimal surface oxidation occurs. The product should be applied in a properly ventilated and well lit area, or protective equipment should be used appropriate to the environment, for example within a firebox. The mixed product should not be filtered or diluted.

A high volume low pressure (HVLP) spray gun should be used with 20-40 psi of clean, oil and water free air. Proper filters for removal of oil and water are required. Alternatively, an airless spray gun may be used. Other types of spray equipment may be suitable. The applicator should practice spraying on scrap metal prior to spraying the actual part to ensure proper coverage density. An airless spray system is preferable for applications on ceramic surfaces such as the refractory materials. Suitable airless spray systems are available from Graco (of Mineapolis, Minn.). Suitable HVLP spray systems, which are desirable for metal/alloy process tubes, are available from G.H. Reed Inc. (of Hanover, Pa.). A high speed agitator may be desirable. Suitable spray gun tips may be selected to provide the proper thickness without undue experimentation.

Controlling the coverage density may be critical to coating performance. The thermal layer thickness should be from about two (2) mils (about 50 microns (μ) to about ten (10) mils (about 255μ), depending upon typed, size and condition of substrate. One (1) mil equals 25.4μ. Proper thickness may vary. If possible, rotate the part 90 degrees at least once to maintain even coverage. Allow 1 to 4 hours of dry time before the part is handled, depending upon humidity and temperature.

An example of the present invention involved coating stainless steel exposed surfaces within a bell furnace, which was manufactured by either LOI or Ebner AG. The stainless steel surfaces of the inner cover, a stainless steel bell, were covered with a thermal protective layer having 15.0% sodium silicate, 69.0% silicon dioxide powder, 15.0% carbon tetraboride, and 1.0% bentonite powder. The thermal protective layer was applied to the surfaces of the bell furnace in the form of a coating comprising 20.0% sodium silicate, 34.5% silicon dioxide powder, 7.5% carbon tetraboride, 0.50% bentonite powder, and 37.5% water. The outer cover was not coated. The heating source was electric imbedded resistance heating. The product annealed was ten (10) tons of stainless steel coils. The bell furnace operated at temperature over annealing cycle of from 100 Celsius to 825 Celsius. The internal bell inert gas was hydrogen ($H_2$).

The cost of the stainless steel inner bell is $80,000 a bell. The typical bell life is three (3) years. An inert gas was disposed within the inner cover. Operational considerations with the bell furnace include uniform product heating, and the cool down/heat up cycle times. The product load was up to 11,000 kg. The energy usage is about $750 a cycle and 165 cycles per year which is $124,000 a year. Non uniform heating of product results when 3% off specification. Heating bell 10 to 20% cooler depending upon the point in the heat cycle. Estimated energy savings from 10% to 15%, increased bell life of 1.5 to 2 times, and reduced cycle time allowed for 17 more cycle per year or 187,000 kg per year. Production was increased 10 to 15%. Improved product quality and uniformity of heating cycle plus reduced rejects were seen. Additionally, reduced usage of approximately 1 to 2% of inert gas for the inner cover annealing products was observed. An overall reduction in system maintenance was also observed.

It is to be understood that the present invention is not limited to the embodiments described above, but encompasses any and all embodiments within the scope of the following claims.

What is claimed is:

1. A bell annealing furnace, comprising:

an outer furnace cover encompassing at least one inner cover, each inner cover having inner and outer surfaces forming a space within the inner cover;

a heating means disposed within the outer furnace cover to heat the outer surface of the inner cover;

at least one high emissivity thermal protective layer at least partially disposed on a substrate surface comprising the inner surface of the inner cover; and means for sealing the inner cover and the outer furnace cover;

wherein each substrate surface is metallic, ceramic, or combinations thereof;

wherein the high emissivity thermal protective layer comprises, a. from about 5% to about 30% of an inorganic adhesive, from about 45% to about 92% of a filler, and from about 1% to about 20% of one or more emissivity agents; or b. from about 5% to about 35% of colloidal silica, colloidal alumina, or combinations thereof, from about 23% to about 79% of a filler, and from about 1% to about 20% of one or more emissivity agents.

2. The bell annealing furnace of claim 1, wherein:

the means for sealing the inner cover and the outer furnace cover comprises a base detachably fixed to and upon which the inner cover and the outer furnace cover rest;

a base upon which the inner cover is detachably fixed with the outer furnace cover detachably sealed to the inner cover;

a base upon which the outer furnace cover rests while the inner cover is detachably sealed to the outer furnace cover; or a sealable door affixed to the furnace and disposed to facilitate access through the outer furnace cover to the space within the inner cover.

3. The bell annealing furnace of claim 1, further comprising:

a cooling means disposed within the outer furnace cover to cool the outer surface of the inner cover.

4. The bell annealing furnace of claim 1, wherein:

the heating means comprises an electrical heating source or a flammable gas burner.

5. The bell annealing furnace of claim 2, wherein:

the heating means comprises at least one electrical resistant element.

6. The bell annealing furnace of claim 1, further comprising:

at least one additional detachable inner cover disposed adjacent the first detachable inner cover encompassed within the outer furnace cover.

7. The bell annealing furnace of claim 1, wherein:

refractory material forms at least a surface disposed within the furnace on a surface of the outer furnace cover, on the inner surface of the inner cover, on the outer surface of the inner cover, on the base, on the door, on the means for holding the annealable material, or on combinations thereof;

wherein a high emissivity thermal protective coating is disposed at least partially on a refractory surface.

8. The bell annealing furnace according to claim 1, further comprising:

a coil support member disposed within the inner space wherein said coil support member has a high emissivity thermal protective layer disposed thereon.

9. The bell annealing furnace according to claim 1, wherein:

a metallic surface forms at least a surface disposed within the furnace comprised of iron, aluminum, alloys, steel, cast iron, stainless steel, and combinations thereof;

wherein a high emissivity thermal protective coating is disposed at least partially on a metallic surface.

10. The bell annealing furnace of claim 1, wherein:

the high emissivity thermal protective layer further comprises from about 1.0% to about 5.0% of a stabilizer;

the high emissivity thermal protective layer further comprises a surfactant;

the high emissivity thermal protective layer further comprises a colorant;

the inorganic adhesive is taken from the group consisting of an alkali/alkaline earth metal silicate taken from the group consisting of sodium silicate, potassium silicate, calcium silicate, and magnesium silicate;

the filler is taken from the group consisting of silicon dioxide, aluminum oxide, titanium dioxide, magnesium oxide, calcium oxide, and boron oxide;

the one or more emissivity agents are taken from the group consisting of silicon hexaboride, boron carbide, silicon tetraboride, silicon carbide, molybdenum disilicide, tungsten disilicide, zirconium diboride, cupric chromite, and metallic oxides; or combinations thereof;

the stabilizer is taken from the group consisting of bentonite, kaolin, magnesium alumina silica clay, tabular alumina, and stabilized zirconium oxide;

the high emissivity thermal protective layer is from about two (2) mils (about 50 microns (μ) to about ten (10) mils (about 255μ) thick; or combinations thereof.

11. The bell annealing furnace of claim 1, wherein:

a high emissivity thermal protective layer contains a. from about 5% to about 30% of an inorganic adhesive, the inorganic adhesive is taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 20% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides;

b. from about 5% to about 35% of colloidal silica, colloidal alumina, or combinations thereof; from about 23% to about 79% of a filler taken from the group consisting of silicon dioxide, aluminum oxide, titanium dioxide, magnesium oxide, calcium oxide, and boron oxide; and from about 1% to about 20% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides;

c. from about 5% to about 30% of an inorganic adhesive, the inorganic adhesive is taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 20% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides; and from about 1% to about 5% of a stabilizer taken from the group consisting of bentonite, kaolin, magnesium alumina silica clay, tabular alumina, and stabilized zirconium oxide; or d. from about 5% to about 35% of colloidal silica, colloidal alumina, or combinations thereof; from about 23% to about 79% of a filler taken from the group consisting of silicon dioxide, aluminum oxide, titanium dioxide, magnesium oxide, calcium oxide, and boron oxide; and from about 1% to about 20% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides; and from about 1.5% to about 5.0% of a stabilizer taken from the group consisting of bentonite, kaolin, magnesium alumina silica clay, tabular alumina, and stabilized zirconium oxide.

12. The bell annealing furnace of claim 1, wherein:

a high emissivity thermal protective layer contains a. from about 10% to about 30% sodium silicate, from about 50% to about 79% silicon dioxide powder, and from about 4% to about 15% of one or more emissivity agents taken from the group consisting of iron oxide, boron silicide, boron carbide, silicon tetraboride, silicon carbide powder, molybdenum disilicide, tungsten disilicide, and zirconium diboride;

b. from about 10% to about 30% sodium silicate, from about 50% to about 79% silicon dioxide powder, from about 4% to about 15% of one or more emissivity agents taken from the group consisting of iron oxide, boron silicide, boron carbide, silicon tetraboride, silicon carbide powder, molybdenum disilicide, tungsten disilicide, and zirconium diboride, and from about 1% to about 5% of a stabilizer taken from the group consisting of bentonite, kaolin, magnesium alumina silica clay, tabular alumina, and stabilized zirconium oxide;

c. from about 10% to about 30% colloidal silica, from about 50% to about 79% silicon dioxide powder, and from about 2% to about 15% of one or more emissivity agents taken from the group consisting of iron oxide, boron silicide, boron carbide, silicon tetraboride, silicon carbide molybdenum disilicide, tungsten disilicide, and zirconium diboride; or d. from about 10% to about 30% colloidal silica, from about 50% to about 79% silicon dioxide powder, from about 2% to about 15% of one or more emissivity agents taken from the group consisting of iron oxide, boron silicide, boron carbide, silicon tetraboride, silicon carbide molybdenum disilicide, tungsten disilicide, and zirconium diboride, and from about 1.5% to about 5.0% of a stabilizer taken from the group consisting of bentonite, kaolin, magnesium alumina silica clay, tabular alumina, and stabilized zirconium oxide.

13. The bell annealing furnace according to claim 1, further comprising:

a high emissivity thermal protective layer at least partially disposed on a substrate surface comprising a surface of the outer furnace cover, a surface of the heating means, or combinations thereof.

14. The bell annealing furnace according to claim 1, wherein:

the outer surface of the inner cover has a high emissivity thermal protective layer at least partially disposed thereon.

* * * * *